US005245852A

United States Patent [19]

Pullum

[11] Patent Number: 5,245,852

[45] Date of Patent: Sep. 21, 1993

[54] METHOD FOR MANUFACTURE OF A RAISED PANEL SHEET METAL SHUTTER

[76] Inventor: Noah A. Pullum, 1101 Herschell St., Burns, Tenn. 37029

[21] Appl. No.: 915,342

[22] Filed: Jul. 17, 1992

[51] Int. Cl.[5] ..... B21C 37/02

[52] U.S. Cl. ..... 72/379.2; 72/211

[58] Field of Search ..... 72/374.2, 211, 220

[56] References Cited

U.S. PATENT DOCUMENTS

| | | | |
|---|---|---|---|
| 800,365 | 9/1905 | Ebert | 72/379.2 |
| 2,095,533 | 10/1937 | Schmidt | 72/379.2 |
| 3,392,566 | 7/1968 | Sporck | 72/220 |
| 5,024,076 | 6/1991 | Warner | 72/211 |
| 5,125,258 | 6/1992 | Warner | 72/379.2 |

*Primary Examiner*—Lowell A. Larson
*Assistant Examiner*—Michael J. McKeon
*Attorney, Agent, or Firm*—I. C. Waddey, Jr.

[57] ABSTRACT

A method for the manufacture of a shutter on a piece of flat stock sheet metal material, said shutter having a raised panel of continuous configuration without any cutting of the stock material, said raised panel having an inner perimeter and an outer perimeter, the method consisting of the steps of establishing a pattern for the inner perimeter on the back side of the sheet metal material, establishing a pattern for the outer perimeter line on the front side of the sheet metal material, establishing a pattern of beveled lines between the inner perimeter line and outer perimeter line, said beveled lined pattern being on the back side of the sheet metal material, gripping the sheet metal material about its perimeter between the jaws of a straight edge brake along the sides and top of the sheet metal material in successive steps, rolling the inner perimeter line of the sheet metal stock with a beveled roller along the back of the sheet metal, rolling the front of the sheet metal material along the outer perimeter line with the beveled edge roller, rolling the back of the sheet metal material with the beveled roller along the lines of the beveled pattern, the rolling of the pattern lines with the beveled roller being performed under sufficient pressure to crimp the sheet metal material and cause the raised panel shutter to snap into configuration as the process is completed.

1 Claim, 3 Drawing Sheets

METHOD FOR MANUFACTURE OF A RAISED PANEL SHEET METAL SHUTTER

BACKGROUND OF THE INVENTION

My invention relates generally to a new and improved method for the manufacture of a raised panel sheet metal shutter. Shutters of the type which are the type manufactured through my improved method are those designed to be attached to the outside of a building structure on each side of the windows thereof as a decorative or ornamental feature. These shutters are made of aluminum or other sheet metal material. Aluminum is particularly adapted to this application because of its strength, flexibility and resistance to rust.

Shutters were originally designed as a protective structure for windows of buildings and the like. They were made from wood and were hingedly connected to the structure so that they could be closed to protect the windows and doors of the structure during inclement weather.

The traditional function of shutters has since given way to the ornamental function of shutters. As an ornamental structure, it has become popular to construct shutters of sheet metal, particularly aluminum, for mounting adjacent windows and doors. Manufactured from aluminum, the shutters are long lasting and generally weather proof. In order to give shutters an ornamental appearance, they have been manufactured with traditional louvered construction, the original design of louvered shutters being intended to allow air to pass through the shutters when they were closed against open windows. Alternatively, the decorative appearance to shutters has been created through a raised panel structure which is the subject matter of the present invention. The raised panel shutters give a three dimensional relief to the shutters and add to the decorative appearance.

In the course of manufacture of raised panel sheet metal shutters, it has, in the past, been necessary to cut the sheet metal in order to secure the relief that is needed for the decorative appearance of the shutter. Cutting the sheet metal creates an undesirable exposed edge. The exposed edge is a problem in several respects. First, it is often times sharp and may cut those persons or animals who come in contact to it. Secondly, the exposed edge is more susceptible to rust and deterioration than is a continuous piece of treated sheet metal. Finally, the shutter is more difficult to manufacture and assemble when the cutting process is involved, and it is particularly difficult to create the smooth transition in the area of the raised panel. The smooth transition is preferable because of its appearance and its safety.

My invention overcomes the deficiencies of the prior art by providing a method for the manufacture of a continuous form sheet metal shutter with a raised panel. My invention allows the construction of such a sheet metal shutter without cutting the sheet metal, through a system of folding and scoring of the sheet metal to create a shutter that is flat around its perimeter while having a three dimensional raised center panel formed of one continuous piece of stock material.

Having described briefly the background of this invention, it is an object of the present invention to provide a method for the construction of a raised panel sheet metal shutter which is constructed from a continuous piece of material without the necessity of cutting the sheet metal.

It is a further object of my invention to provide a method for the construction of a raised panel sheet metal shutter which produces a shutter having flat primary and secondary surfaces and which eliminates any warping of the shutter.

My invention will be better understood upon review of the following detailed description of the preferred embodiment in conjunction with the drawings wherein.

FIG. 7A–D shows a cross section of the sheet metal during the four primary steps of my process.

Figure 8:
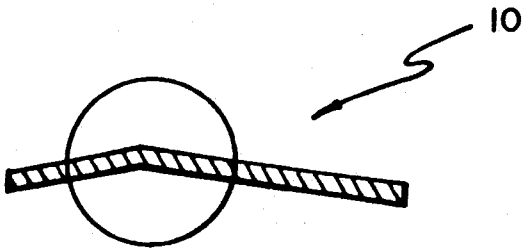

FIG. 8 shows a cross section of the sheet metal after one step of my process.

Figure 9:
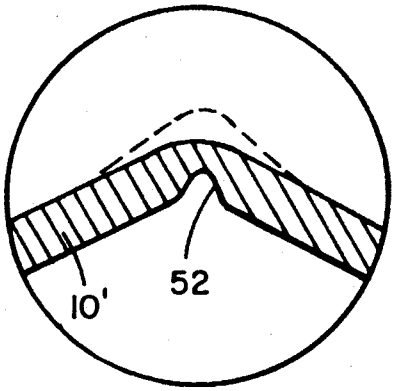

FIG. 9 shows an exploded view of the section in FIG. 8.

DESCRIPTION OF THE PREFERRED EMBODIMENT

Figure 2:
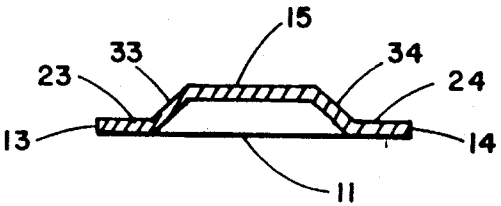
FIG. 2 is a cross section of the shutter of FIG. 1.
Figure 1:
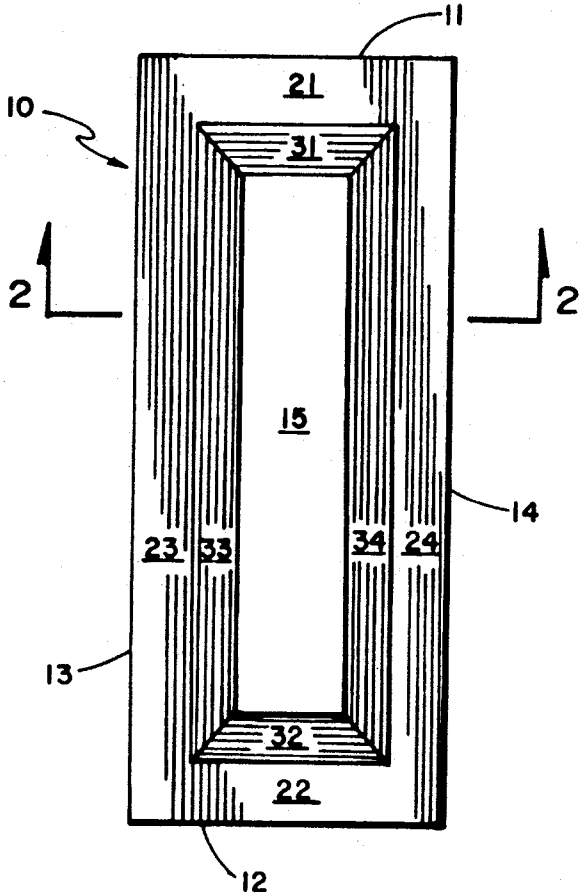
FIG. 1 is a frontal view of a raised panel sheet metal shutter of the type which is manufactured by my method.

Referring now to the drawings wherein like referenced numerals represent the same part throughout this specification, FIGS. 1 and 2 show in plain view and cross section a shutter of the type that is manufactured through the use of my method. The cross section of FIG. 2 is somewhat exaggerated in comparison to the size of the shutter shown in FIG. 1. Generally the sheet metal from which this shutter is manufactured is of a 16–18 gauge material, being manufactured in large quantities and stored as rolled stock material of a thickness in the ⅛–1/16 range.

Referring still to FIGS. 1 and 2, shutter 10 that is manufactured by my process has a top 11, a bottom 12 and sides 13 and 14 which define the perimeter of the shutter.

The top of the shutter has a flat section 21, the bottom of the shutter has a flat section 22 and the sides of the shutter have flat sections 23 and 24. The flat top section 21 is connected to the raised panel 15 by top slope portion 31, the flat bottom section 22 is connected to the raised panel 15 by bottom sloped portion 32 and the flat side sections 23 and 24 are connected to the raised panel 15 by side sloped portions 33 and 34. As can be seen from FIG. 2, the side sloped portion 33 and 34 are basically flat and positioned at an angle to the flat raised panel 15 and the flat side sections 23 and 24.

Figure 4:
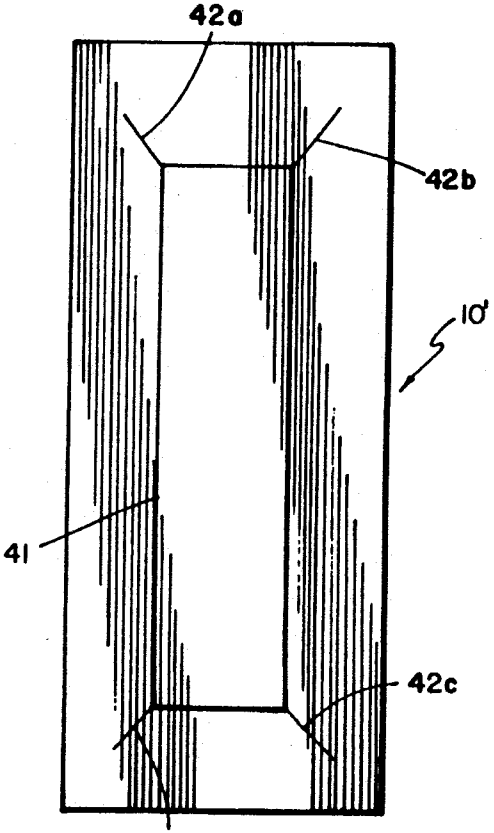
FIG. 4 shows the back of the shutter during an intermediate step of my process.
Figure 3:
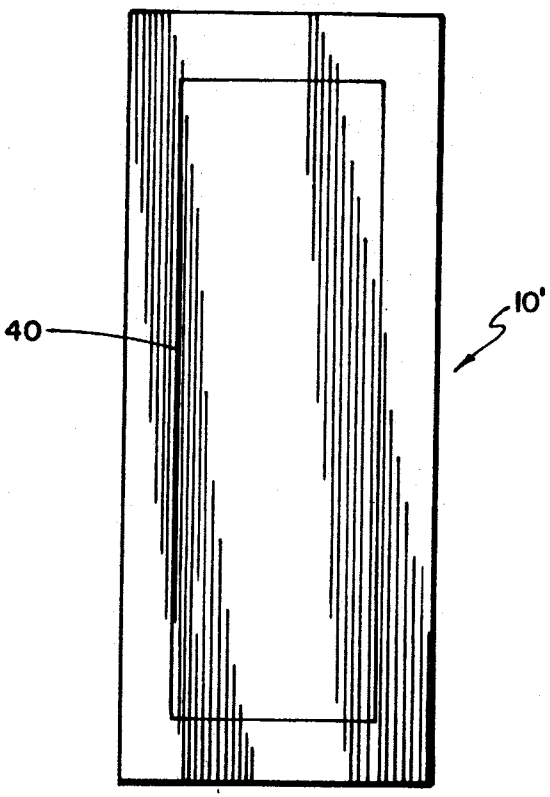
FIG. 3 shows the front of the shutter during an intermediate stage of my process.

Referring now to FIGS. 3 and 4, there is illustrated a piece of stock material 10' which will be a rectangular, flat, aluminum or other sheet metal material. FIG. 3 shows the front of the shutter to be constructed from the stock materials 10' and FIG. 4 shows the back side of the stock material 10'. As can be seen from FIGS. 3 and 4, the pattern of the raised panel has been partially marked onto the stock material 10'. The front of the stock material 10' as shown in FIG. 3, has been marked with the outline of the outer perimeter 40 of the proposed panel. FIG. 4 shows the back side of the stock material 10' marked with the inner perimeter 41 of the raised panel and the beveled lines 42*a–d*.

Figure 6:
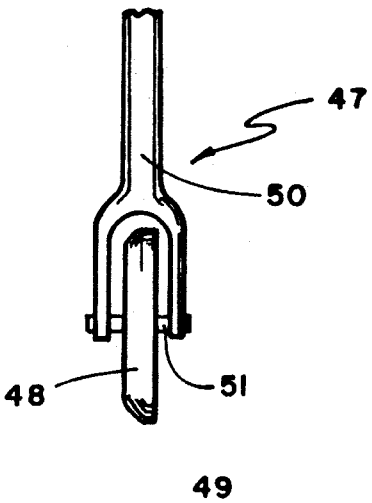
FIG. 6 shows a beveled edge roller of the type used in implementing my process.
Figure 5:
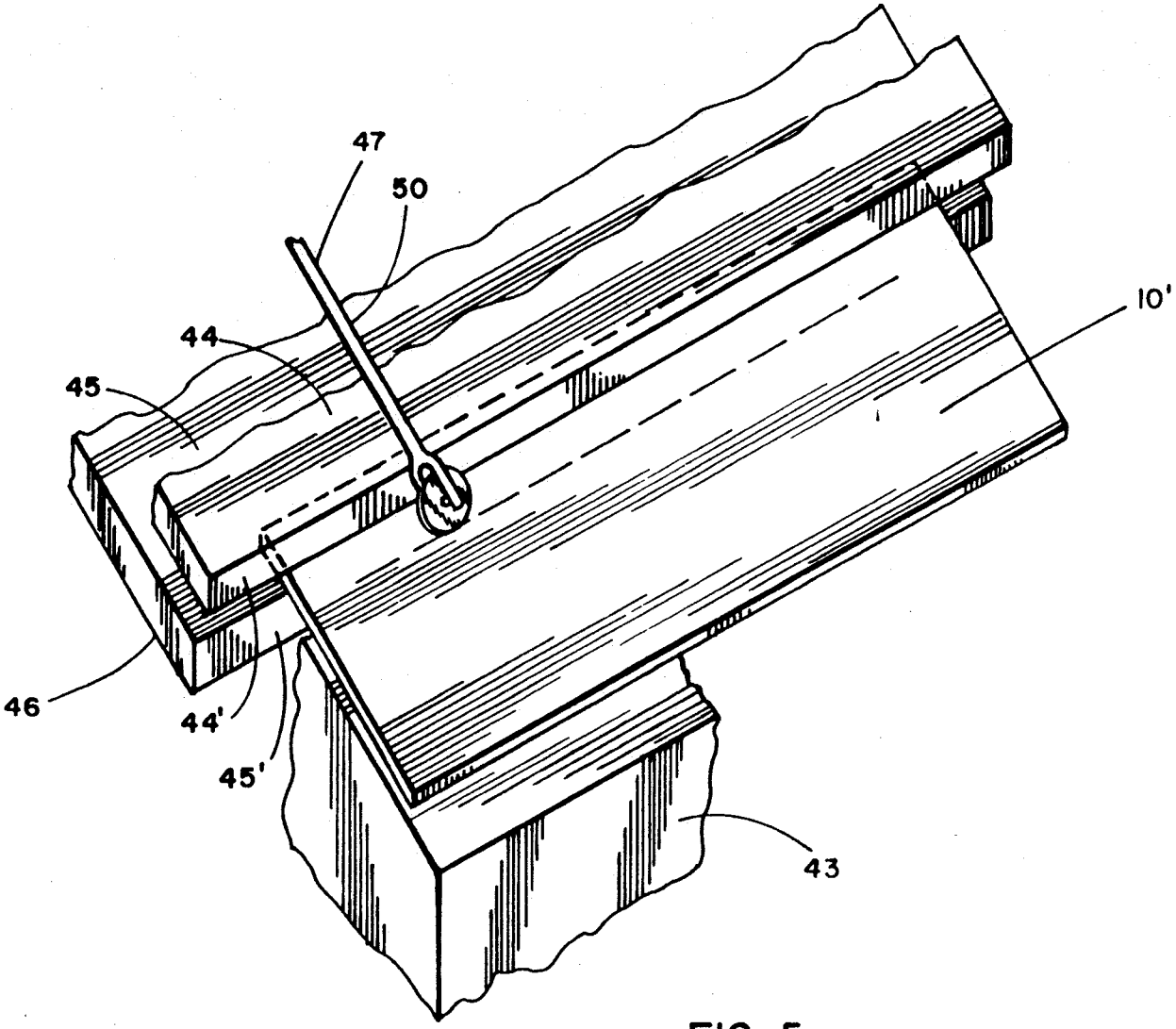
FIG. 5 shows the sheet metal held in a straight-edge brake during an intermediate step of my process.

Referring now to FIGS. 5 and 6, the treatment of the stock material 10' is illustrates. In FIG. 5, the stock material 10' sits on a work table 43 and is firmly held between the two jaws 44 and 45 of a straight edge brake 46.

FIG. 6 shows a beveled edge roller of the type used in conjunction with my method. As can be seen from FIG. 6, the roller 47 has a wheel 48 with a beveled perimeter 49. The wheel 48 is mounted to a support structure 50 via an axle 51. By this structure, the wheel 48 is allowed to rotate freely within the roller 47. The support structure 50 can be machined mounted for automatic implementation of may process or may be operated by hand when my process is implemented manually.

FIG. 7, steps A–D show the cross sectional appearance of the sheet metal during different stages of my process. FIG. 7A shows the first roll of the roller 47, FIG. 7B shows the second roll, FIG. 7C shows a third roll and FIG. 7D shows a fourth roll. These four rolls of the sheet metal with the roller 47 show the four primary steps of my method along the sides of the stock material. Similar rolls will be made at the top and bottom of the material to connect the lines identified in FIGS. 3 and 4 and finally the rolls are made along the lines 42 *a–d* as shown in FIG. 4 to complete the process.

Referring again to FIG. 5, it will be seen that the stock material 10' is placed between the jaws of 44, 45 of the brake 46 and secured firmly in that position while resting on the work table 43. In this position, the roller 47 is rolled along the inner perimeter 41 on the back side of the stock material 10'. The stock material 10' is inserted within the brake 46 a sufficient depth so that the roller is running in close proximity to the face 44' and 45' of the jaws of the straight edge brake 46. Once a side portion of the inner perimeter 41 is rolled with the roller 47, the stock material 10' will be gripped on the opposing edge between the jaws 44, 45 of the straight edge brake 46 and the perimeter line 41 rolled by the roller 47 along the opposite edge. Similarly, the stock material 10' will be gripped between the jaws 44, 45 of the straight edge brake 46 at the top and bottom and the top and bottom portion of the perimeter line 41 rolled while the stock material 10' is being held on the work table in that fashion. The roller is rolled along the lines showing FIGS. 3 and 4 under pressure to crimp the stock material as can be seen in FIG. 9 of the drawings. This will initially cause a buckling of the stock material 10', but the straight edge brake tends to hold the stock material 10' in a flat plane while the crimp 52 is being impressed in the stock material 10'. However, the crimp causes a bias of the stock material in the manner shown in exaggerated fashion in FIG. 9.

Once the inner perimeter line 41 has been rolled with the roller 47, the stock material 10' is rolled from the front side along the outer perimeter line 40. Once again, the stock material is rolled with the roller 47 while the perimeter edge of the stock material is being held between the jaws 44, 45 of the brake 46. The outer perimeter line 40 is rolled with sufficient pressure on the roller to create a crimp 52 in the front side of stock material 10'.

Figure 7A:
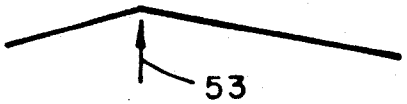
Figure 7B:
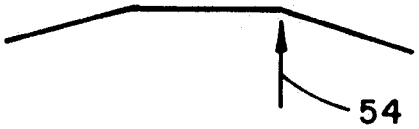
Figure 7C:
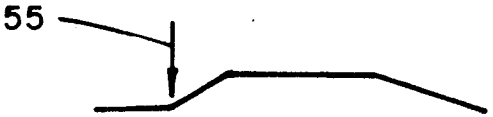
Figure 7D:
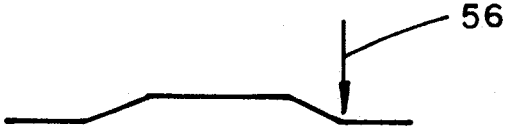

Referring to FIG. 7, FIG. 7A shows the first roll of the stock material with the arrow 53 showing the direction of the application of the pressure on the beveled edge roller 47. The second roll of the back side of the stock material 10' is shown by arrow 54. The top and bottom of the back side of the panel are rolled similarly although that portion of the roll is not shown in FIG. 7. Once the two sides and the top and bottom of the inner perimeter line 41 have been rolled, the front side of the stock material 10' is rolled in stages as illustrated by arrows 55 and 56. In addition to rolling the sides of the stock material 10' on the front of the material, the top and bottom portion of the outer perimeter line 40 are also rolled. The next step is to roll the beveled lines 42 *a–d* which releases the pressure created by the crimp 52 and allows the raised panel shutter to pop into position and create the shutter illustrated in FIGS. 1 and 2.

Having described the preferred embodiment of my invention, I claim:

1. A method of producing a shutter having a raised panel with an outer perimeter and an inner perimeter from a piece of flat sheet metal stock, said shutter having an outer perimeter with a top, bottom and sides, including the following steps:

a. establishing a pattern for the outer perimeter of the raised panel by creating an outer perimeter line for the raised panel on the front side of the sheet metal stock, said outer perimeter line being spaced inwardly from the top, bottom and sides of the outer perimeter of the shutter;

b. establishing a pattern for the inner perimeter of the raised panel by creating an inner perimeter line for the raised panel on the back side of the sheet metal stock, said inner perimeter line being spaced inside the outer perimeter line for the raised panel;

c. establishing a pattern of beveled lines on the back side of the shutter between the inner perimeter line and the outer line of the raised panel;

d. gripping the stock material in succession along its sides, top and bottom between the jaws of a straight edge brake and rolling the inner perimeter line of the raised panel with a beveled roller under sufficient pressure to crimp the stock material and cause it to deform in a direction opposite the force being applied to the stock material by the pressure of the beveled roller, the inner perimeter line being rolled along each portion thereof as such portion is being held between the jaws of the straight edge brake;

e. gripping the stock material in succession along the sides, top and bottom between the jaws of a straight edge brake and rolling the outer perimeter line of the raised panel with a beveled roller under sufficient pressure to crimp the stock material and cause it to deform in a direction opposite the force being applied to the stock material by the pressure of the beveled edge roller, the outer perimeter line being roller along each portion thereof as such portion is being held between the jaws of the straight edge brake; and f. rolling the back side of the stock material along the bevel lines of the pattern with a beveled roller.

* * * * *